US006975270B2

(12) United States Patent
Ohara et al.

(10) Patent No.: US 6,975,270 B2
(45) Date of Patent: Dec. 13, 2005

(54) ANTENNA UNIT

(75) Inventors: Katsuhiro Ohara, Kariya (JP); Toru Yamazaki, Chita (JP); Seishin Mikami, Toyota (JP); Shinji Fukui, Okazaki (JP)

(73) Assignees: DENSO Corporation, Kariya (JP); Nippon Soken, Inc., Nishio (JP)

( * ) Notice: Subject to any disclaimer, the term of this patent is extended or adjusted under 35 U.S.C. 154(b) by 4 days.

(21) Appl. No.: 10/765,762

(22) Filed: Jan. 26, 2004

(65) Prior Publication Data

US 2004/0155821 A1 Aug. 12, 2004

(30) Foreign Application Priority Data

Jan. 28, 2003 (JP) ..... 2003-018869

(51) Int. Cl.[7] ..... H01Q 1/38; H01Q 1/48
(52) U.S. Cl. ..... 343/700 MS; 343/846
(58) Field of Search ..... 343/700 MS, 702, 343/846

(56) References Cited

U.S. PATENT DOCUMENTS 5,886,668 A * 3/1999 Pedersen et al. ..... 343/702
2002/0175862 A1 * 11/2002 Hunter et al. ..... 343/700 MS

FOREIGN PATENT DOCUMENTS

JP 2001-159672 6/2001
JP 2002-111377 4/2002

* cited by examiner

*Primary Examiner*—Hoang V. Nguyen
(74) *Attorney, Agent, or Firm*—Harness, Dickey & Pierce, PLC

(57) ABSTRACT

In an antenna unit, a radiating element and an antenna ground element are held to a dielectric member, which is primarily provided for increasing electric lines of force passing from the radiating element to the antenna ground element. The radiating element and the antenna ground element are arranged with a predetermined slant relative to a circuit board. Therefore, the number of parts or the complexity of the assembly work for the antenna unit does not increase in comparison with an antenna unit holding a radiating element with an antenna base or a bracket. Furthermore, the slant can be adjusted to any angle during the assembly work. Thus, the maximum gain angle of the directional patterns can be adjusted without increasing the size of the antenna unit.

11 Claims, 3 Drawing Sheets

ANTENNA UNIT

CROSS REFERENCE TO RELATED APPLICATION

This application is based on and incorporates herein by reference Japanese Patent Application No. 2003-18869 filed on Jan. 28, 2003.

FIELD OF THE INVENTION

The present invention relates to an antenna unit having a dielectric member between a radiating element and an antenna ground element.

BACKGROUND OF THE INVENTION

Antennas unit having a radiating element arranged with a predetermined slant relative to a circuit board is proposed in Japanese Patent Application No. 2002-111377 and 2001-159672. In the antenna units, the radiating element is held by an antenna base or a bracket, namely, parts for holding the radiating element and complicated assembling work are required. Moreover, an array antenna is required for adjusting the maximum gain angle of directional patterns with a microstrip antenna. Thus, the antenna units are large in size.

SUMMARY OF THE INVENTION

The present invention therefore has an object to provide an antenna unit in which the maximum gain angle of directional patterns can be adjusted without increasing the number of parts or complexity in the assembly work, and therefore the size of the antenna unit does not increase. In an antenna unit of the present invention, a radiating element and an antenna ground element are held to a dielectric member with a predetermined slant relative to a circuit board.

The dielectric member is primarily provided for increasing electric lines of force passing from the radiating element to the antenna ground element. By increasing the electric lines of force, the size of the antenna unit is reduced. Namely, an additional part, such as an antenna base and a bracket, is not required for holding the radiating element and the antenna ground element. As a result, the number of parts or complexity of assembly work does not increase. The slant of the radiating element and the antenna ground element can be adjusted to any angle during the assembly work. Thus, the maximum gain angle of the directional patterns can be adjusted without increasing the size of the antenna unit.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENT

Figure 1:
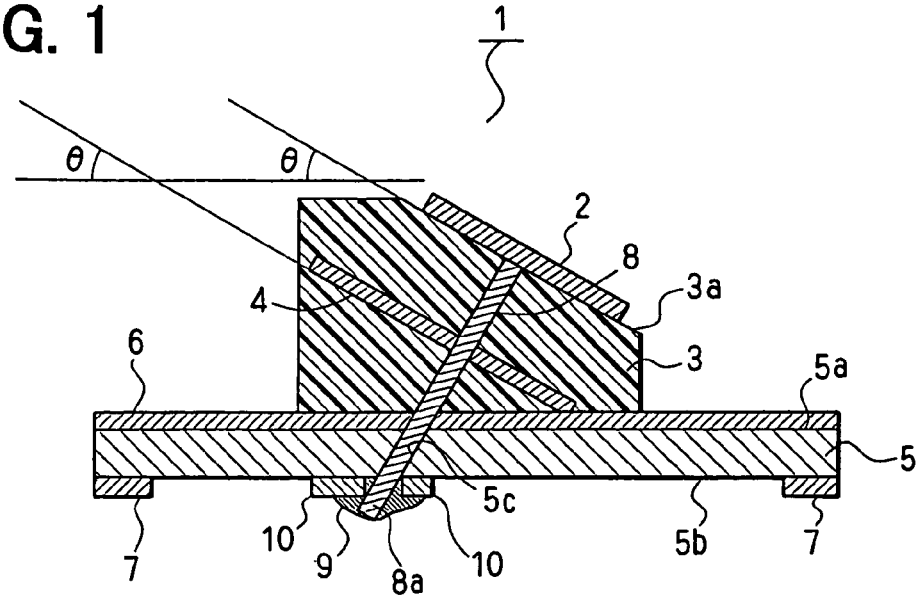
FIG. 1 is a cross-sectional side view of an antenna unit according to the first embodiment of the present invention.

The preferred embodiments of the present invention will be explained with reference to the accompanying drawings. In the drawings, the same numerals are used for the same components and devices.

[First Embodiment]

Referring to FIG. 1, an antenna unit 1 includes a radiating element 2, a dielectric member 3, an antenna ground element 4, and a circuit board 5. The radiating element 2, formed in a shape of a plate, functions as a part of an antenna for an onboard unit of an electronic toll collection (ETC) system. It is mounted on a slanting surface 3*a* of a resin dielectric member 3. The antenna ground element 4 is arranged approximately parallel to the radiating element 2 inside the dielectric member 3 by insert molding. The radiating element 2 and the antenna ground element 4 are held with a slant θ (a predetermined slant) relative to the circuit board 5. The dielectric member 3 is primarily provided between the radiating element 2 and the antenna ground element 4 for increasing electric lines of force to reduce the size of the antenna unit 1.

The first ground layer 6 and the second ground layer 7 are formed on surfaces of the circuit board 5. The first ground layer 6 is formed on a top surface 5*a* on which the dielectric member 3 is mounted, and the second ground layer 7 is formed on a back surface 5*b* opposite to the top surface. Various kinds of electronic components (not shown) are mounted on the first and the second layers 6 and 7. A power supply pin 8 is provided for supplying power to the radiating element 2. It penetrates through the circuit board 5 via a through hole 5*c* and the first end 8*a* is electrically connected to a conductor pattern 10 with solder 9 on the back surface 5*b*.

The antenna unit 1 is assembled as follows. The radiating element 2 is connected with the second end of the power supply pin 8, which connects the radiating element 2, the dielectric member 3, and the antenna ground element 4 all together. The dielectric member 3 is arranged on the circuit board 5 together with the radiating element 2 and the antenna ground element 4. The first end 8*a* of the power supply pin 8 is soldered to the conductor pattern 10 on the circuit board 5.

Figure 2:
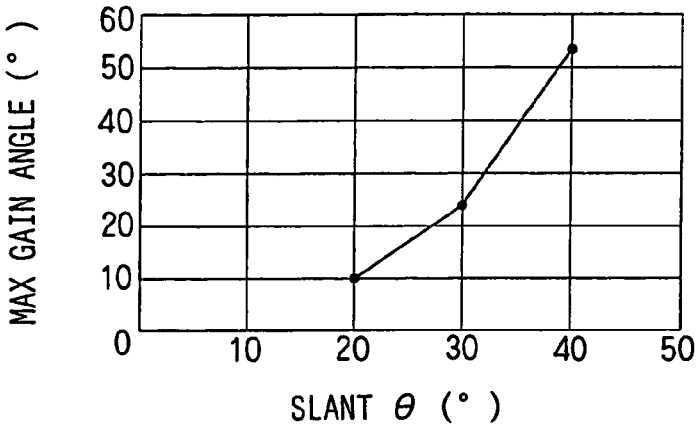
FIG. 2 is a graph showing a slat of a radiating element and an antenna ground element relative to a circuit board versus the maximum gain angle of directional patterns according the first embodiment.

The maximum gain angle of directional patterns varies according to the slant θ as shown in FIG. 2. The maximum gain angle is an angle at which a gain of the directional patterns becomes the maximum. The maximum gain angle is approximately 10, 25, and 54 degrees when the slant θ is set to about 20, 30, and 40 degrees, respectively. Namely, the maximum gain angle can be adjusted to a desired angle by setting the slant to an appropriate angle. Communication between the onboard ETC unit and a roadside antenna is properly performed when the slant θ is set so that the maximum gain angle θ matches the direction of the roadside antenna.

The radiating element 2 and the antenna ground element 4 are held with the dielectric member 3, and arranged with the predetermined slant relative to the circuit board 5. Namely, the antenna base or the bracket is not required for holding the radiating element 2 and the antenna ground element 4. Therefore, the number of parts or the complexity of the assembly work for the antenna unit 1 does not increase.

Furthermore, the slant θ of the radiating element 2 and the antenna ground element 4 can be adjusted to any angle during the assembly work. Thus, the maximum gain angle of the directional patterns can be adjusted without increasing the size of the antenna unit 1. The dielectric member 3 is made of a resin and the antenna ground element 4 is arranged in the dielectric member 3 by insert molding. Therefore, the antenna ground element 4 is properly fixed to the dielectric member 3.

[Second Embodiment]

Figure 3:
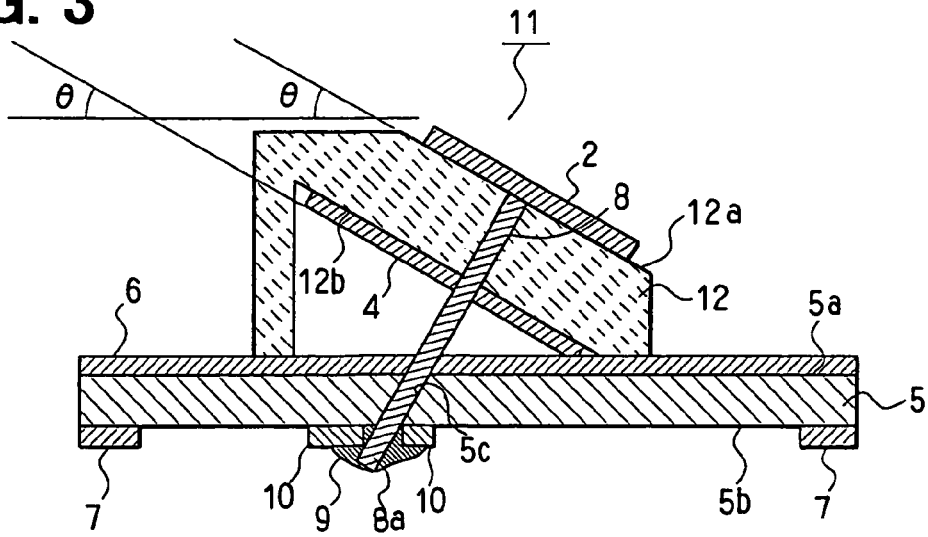
FIG. 3 is a cross-sectional side view of an antenna unit according to the second embodiment of the present invention.

Referring to FIG. 3, an antenna unit 11 has a dielectric member 12 made of ceramic. Other components of the antenna unit 11 are the same as the antenna unit 1 shown in FIG. 1, and therefore they are not discussed here. In the antenna unit 11, the radiating element 2 and the antenna ground element 4 are mounted to the top slanting surface 12*a* and the bottom slanting surface 12*b* of the dielectric member 12, respectively. The radiating element 2 and the antenna ground element 4 are held to the dielectric member 12 with a slant θ relative to the circuit board 5.

The radiating element 2 and the antenna ground element 4 are held by the dielectric member 12, and arranged with the slant θ relative to the circuit board 5. Therefore, the number of parts or the complexity of the assembly work for the antenna unit 11 does not increase for the same reasons as the first embodiment.

Furthermore, the slant θ of the radiating element 2 and the antenna ground element 4 can be adjusted to any angle during the assembly work. Thus, the maximum gain angle of the directional patterns can be adjusted without increasing the size of the antenna unit 11.

[Third Embodiment]

Figure 4:
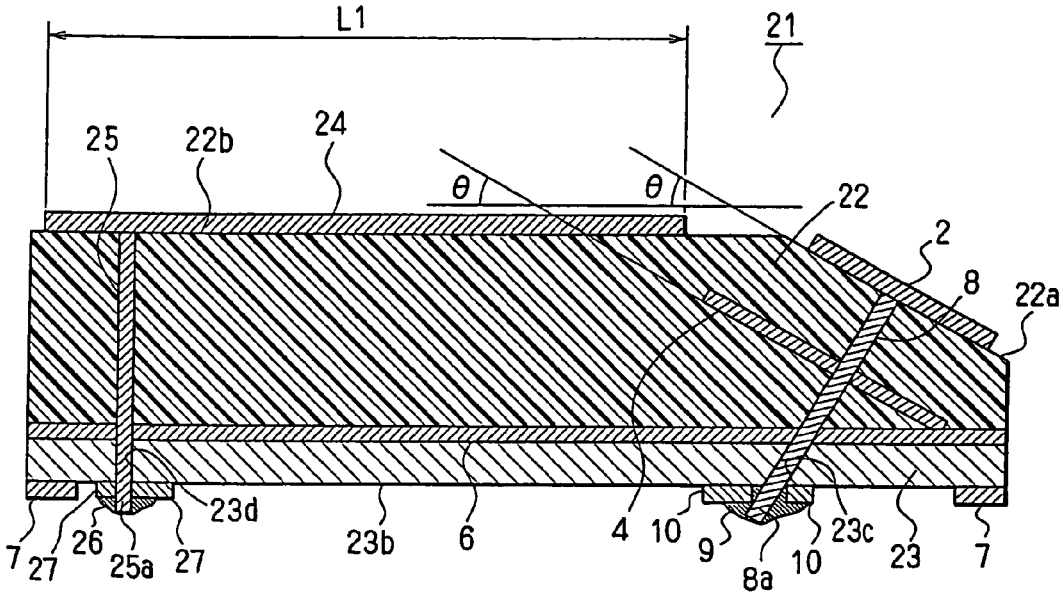
FIG. 4 is a cross-sectional side view of an antenna unit according to the third embodiment of the present invention.
Figure 5:
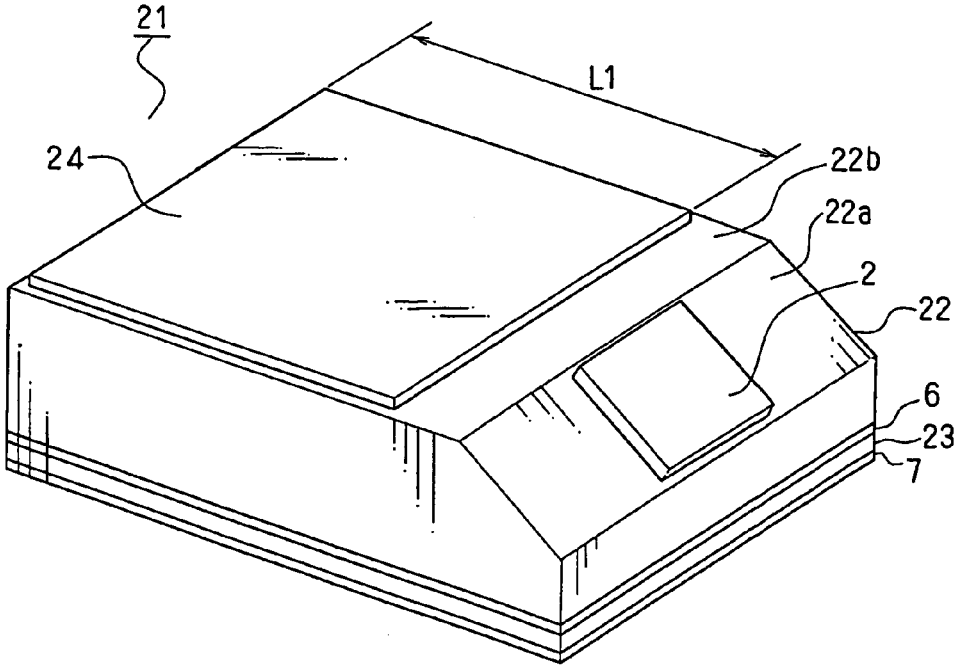
FIG. 5 is a perspective view of the antenna unit according to the third embodiment.

Referring to FIGS. 4 and 5, an antenna unit 21 has a second radiating element 24 that functions as a part of an antenna for a GPS receiver, in addition to the radiating element 2 (first radiating element). The antenna unit 21 includes the same components as the antenna unit 1 shown in FIG. 1, and they are not discussed here.

In the antenna unit 21, the first radiating element 2 is mounted to a slanting surface 22*a* of a dielectric member 22. The antenna ground element 4 is arranged approximately parallel to the first radiating element 2 inside the dielectric member 22 by insert molding. The first radiating element 2 and the antenna ground element 4 are held to the dielectric member 22 with a slant θ relative to a circuit board 23.

The second radiating element 24 is formed in the shape of a plate as with the radiating element 2 and integrally arranged with the dielectric member 22. More specifically, the second radiating element 24 is mounted to the top surface 22*b* of the dielectric member 22 adjacent to the first radiating element 2. The power supply pin 8 penetrates through the circuit board 23 via a through hole 23*c* and the first end 8*a* is electrically connected to the conductor pattern 10 with solder 9 on the back surface 23*b*. A power supply pin 25 is provided for supplying power to the radiating element 24. It penetrates through the circuit board 23 via a through hole 23*d*, and the first end 25*a* is electrically connected to the conductor pattern 27 with solder 26 on the back surface 23*b*.

The antenna unit 21 can have a radiating element that functions as a part of an antenna for the VICS or for the telephone communication system in place of the second radiating element 24. The antenna unit 21 can have all the radiating elements.

In the antenna unit 21, the radiating element 2 and the antenna ground element 4 are held with the dielectric member 22, and arranged with the slant θ relative to the circuit board 23. Therefore, the number of parts or the complexity of the assembly work for the antenna unit 21 does not increase by the same reasons as the first embodiment.

Furthermore, the slant θ of the radiating element 2 and the antenna ground element 4 can be adjusted to any angle during the assembly work. Thus, the maximum gain angle of the directional patterns can be adjusted without increasing the size of the antenna unit 21. The antenna unit 21 is configured as a multifunction antenna by integrally arranged the second radiating element 24 in the antenna unit 21 in addition to the first radiating element 2.

[Fourth Embodiment]

Figure 6:
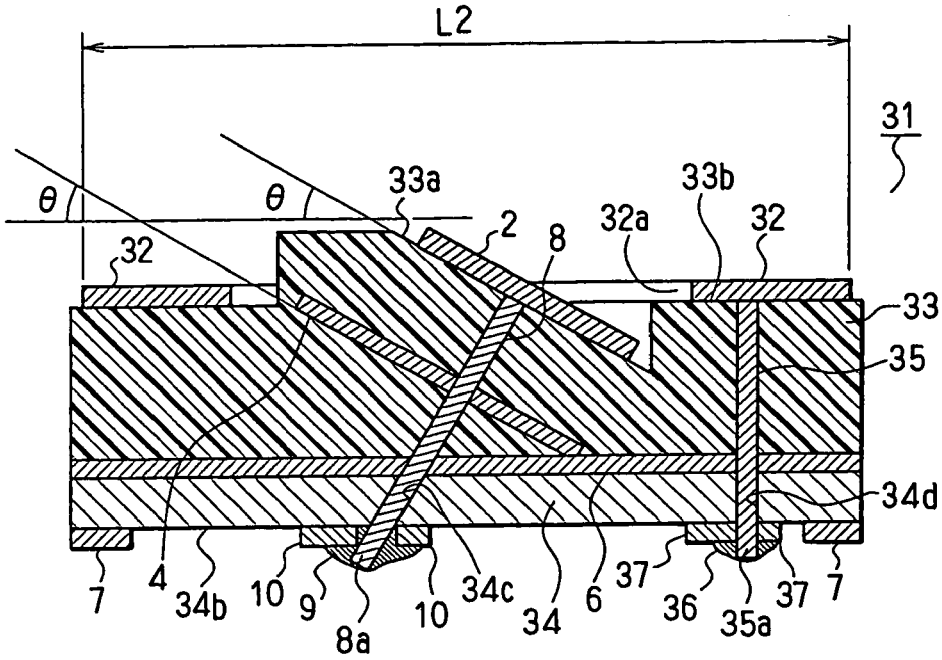
FIG. 6 is a cross-sectional side view of an antenna unit according to the fourth embodiment of the present invention.
Figure 7:
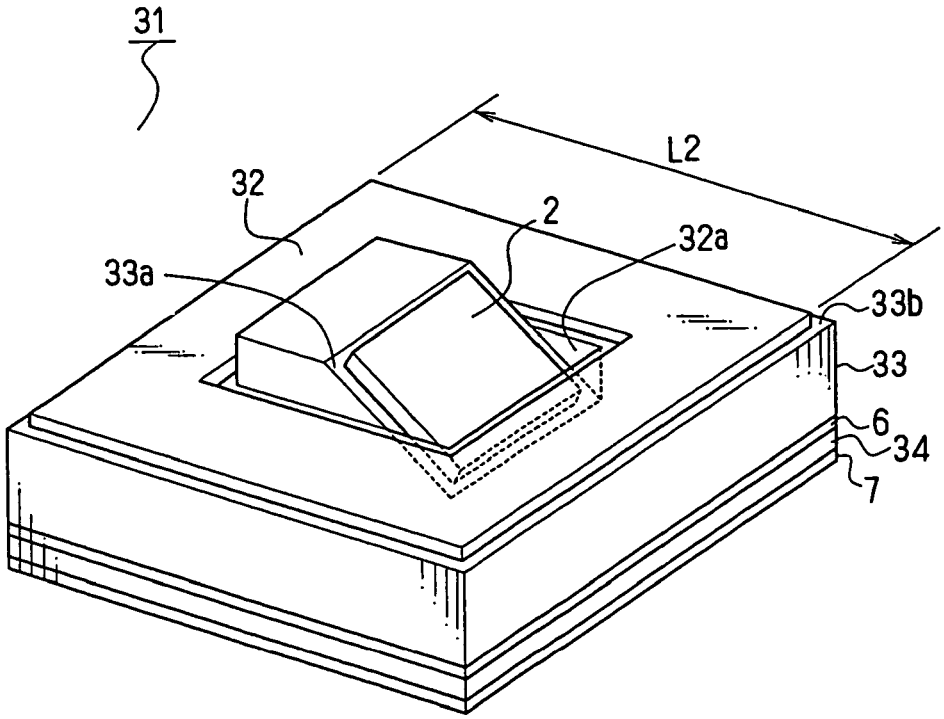
FIG. 7 is a perspective view of the antenna unit according to the fourth embodiment.

Referring to FIGS. 6 and 7, an antenna unit 31 includes the same components as the antenna unit 21 shown in FIGS. 4 and 5, and they are not discussed here. The antenna unit 31 includes a second radiating element 32 that functions as a part of an antenna for a GPS receiver in place of the second radiating element 24. The second radiating element 32 having a hollow portion 32*a* is mounted to the top surface 33*b* of a dielectric member 33. The radiating element 2 is arranged in the hollow portion 32*a* and mounted to the slanting surface 33*a* of the dielectric member 33. The antenna ground element 4 is arranged approximately parallel to the radiating element 2 inside the dielectric member 33 by insert molding. The first radiating element 2 and the antenna ground element 4 are held to the dielectric member 33 with a slant θ relative to a circuit board 34.

The power supply pin 8 penetrates the circuit board 34 via a through hole 34*c* and the first end 8*a* is electrically connected to the conductor pattern 10 with solder 9 on the back surface 34*b*. A power supply pin 35 is provided for supplying power to the radiating element 32. It penetrates through the circuit board 34 via a through hole 34*d*, and the first end 35*a* is electrically connected to the conductor pattern 37 with solder 36 on the back surface 34*b*.

An outside dimension L1 of the radiating element 24 and an outside dimension L2 of the radiating element 32 are equal. The size of the antenna unit 31 is decreased by arranging the radiating element 2 in the hollow portion 32*a* in comparison with the antenna unit 21.

In the antenna unit 31, the radiating element 2 and the antenna ground element 4 are held with the dielectric member 33, and arranged with the slant θ relative to the circuit board 34. Therefore, the number of parts or the complexity of the assembly work for the antenna unit 31 does not increase by the same reasons as the first embodiment.

Furthermore, the slant θ of the radiating element 2 and the antenna ground element 4 can be adjusted to any angle during the assembly work. Thus, the maximum gain angle of the directional patterns can be adjusted without increasing the size of the antenna unit 31. The antenna unit 31 is configured as a multifunction antenna by integrally arranged the second radiating element 32 in the antenna unit 31 in addition to the first radiating element 2. Since the first radiating element 2 is arranged in the hollow portion 32*a* of the second radiating element 32, the size of the antenna unit 31 is decreased compared to the antenna unit 21.

The present invention should not be limited to the embodiment previously discussed and shown in the figures, but may be implemented in various ways without departing from the spirit of the invention. For example, the dielectric members 3, 22, 33 can be made of materials other than resin or ceramic. The radiating elements 2, 24, 32 can be mounted to separate dielectric members.

What is claimed is:

1. An antenna unit comprising:
a first radiating element;
an antenna ground element;
a dielectric member; and
a circuit board, wherein
the dielectric member is arranged between the first radiating element and the antenna ground element, and
the first radiating element and the antenna ground element are held to the dielectric member with a predetermined slant relative to the circuit board; wherein
the dielectric member is made of resin; and
the antenna ground element is arranged inside the dielectric element by insert molding.

2. An antenna unit comprising:
a first radiating element;
an antenna ground element;
a dielectric member; and
a circuit board, wherein
the dielectric member is arranged between the first radiating element and the antenna ground element, and
the first radiating element and the antenna ground element are held to the dielectric member with a predetermined slant relative to the circuit board; wherein
the antenna unit further comprises a second radiating element, the second radiating element is integrally arranged with the dielectric member.

3. The antenna unit according to claim 2, wherein the first radiating element and the second radiating element are arranged adjacent to each other.

4. The antenna unit according to claim 2, wherein:
the second radiating element has a hollow portion; and
the first radiating element is arranged in the hollow portion.

5. An antenna unit comprising:
a first radiating element;
an antenna ground element;
a dielectric member; and
a circuit board, wherein
the dielectric member is arranged between the first radiating element and the antenna ground element, and
the first radiating element and the antenna ground element are held to the dielectric member with a predetermined slant relative to the circuit board; wherein
the first radiating element functions as a part of an antenna for an onboard unit of an electronic toll collecting system.

6. An antenna unit comprising:
a first radiating element;
an antenna ground element;
a dielectric member; and
a circuit board, wherein
the dielectric member is arranged between the first radiating element and the antenna ground element, and
the first radiating element and the antenna ground element are held to the dielectric member with a predetermined slant relative to the circuit board; wherein
wherein the first radiating element, the antenna ground element and the dielectric member are integrated and mounted on and connected to the circuit board.

7. The antenna unit according to claim 6, wherein:
the dielectric member is made of resin; and
the antenna ground element is arranged inside the dielectric element by insert molding.

8. The antenna unit according to claim 6, wherein:
the antenna unit further comprises a second radiating element, the second radiating element is integrally arranged with the dielectric member.

9. The antenna unit according to claim 8, wherein the first radiating element and the second radiating element are arranged adjacent to each other.

10. The antenna unit according to claim 8, wherein:
the second radiating element has a hollow portion; and
the first radiating element is arranged in the hollow portion.

11. The antenna unit according to claim 6, wherein
the first radiating element functions as a part of an antenna for an onboard unit of an electronic toll collecting system.

* * * * *